United States Patent [19]

Israel

[11] Patent Number: 4,793,489

[45] Date of Patent: Dec. 27, 1988

[54] TAMPER RESISTANT PACKAGE AND METHOD FOR DETECTING TAMPERING WITH A PACKAGED PRODUCT

[76] Inventor: Howard A. Israel, 853 S. Bedford St., Los Angeles, Calif. 90035

[21] Appl. No.: 11,023

[22] Filed: Feb. 5, 1987

[51] Int. Cl.[4] ..... G01N 21/78; B65D 55/02

[52] U.S. Cl. ..... 206/459; 116/201; 116/202; 340/641; 422/56

[58] Field of Search ..... 206/459, 807; 340/605, 340/611, 641; 116/201, 202, 206, 207; 436/136; 422/56, 57

[56] References Cited

U.S. PATENT DOCUMENTS

| | | | |
|---|---|---|---|
| 1,567,534 | 1/1924 | Maude | 436/136 |
| 3,119,670 | 11/1961 | Mitchell et al. | 436/136 |
| 3,262,756 | 7/1966 | Keilholtz et al. | 436/38 |
| 3,545,930 | 12/1967 | Walker et al. | 436/136 |
| 3,663,176 | 5/1972 | Cagle et al. | 436/116 |
| 4,003,709 | 1/1977 | Eaton et al. | 116/207 |
| 4,169,811 | 10/1979 | Yoshikawa et al. | 436/138 |
| 4,288,403 | 9/1981 | Komamiya et al. | 422/83 |
| 4,349,509 | 9/1982 | Yoshikawa et al. | 422/57 |
| 4,505,399 | 3/1985 | Weiner | 215/230 |
| 4,511,052 | 4/1985 | Klein et al. | 215/230 |
| 4,526,752 | 7/1985 | Perlman et al. | 422/56 |
| 4,591,062 | 5/1986 | Sandhaus | 206/807 |

*Primary Examiner*—Stephen Marcus

*Attorney, Agent, or Firm*—Christie, Parker & Hale

[57] ABSTRACT

A tamper resistant package has an inaccessible aerobic atmosphere indicator in the form of an incandescent filament. Specifically, the package comprises a container having an access opening, a first interior compartment for product storage exposed to the access opening, a second interior compartment isolated from the opening, and a lid adapted to seal the access opening. An aerobic atmosphere indicator is disposed in the second compartment. The response of the indicator is transmitted to the exterior of the container. Gas flow is permitted from the first compartment to the second compartment without permitting removal of the indicator from the second compartment. As a result, the indicator is protected from tampering in the event the seal is broken and the lid is opened.

A product for human consumption and the indicator are placed in the package. Thereafter, the package is atmospherically evacuated and sealed. Pending use of the product, the resulting package is then stored. Thereafter, the indicator is activated by electric current to determine whether the interior of the package has been violated during storage. If the package tests negative, the container is opened and the product is removed for consumption.

8 Claims, 1 Drawing Sheet

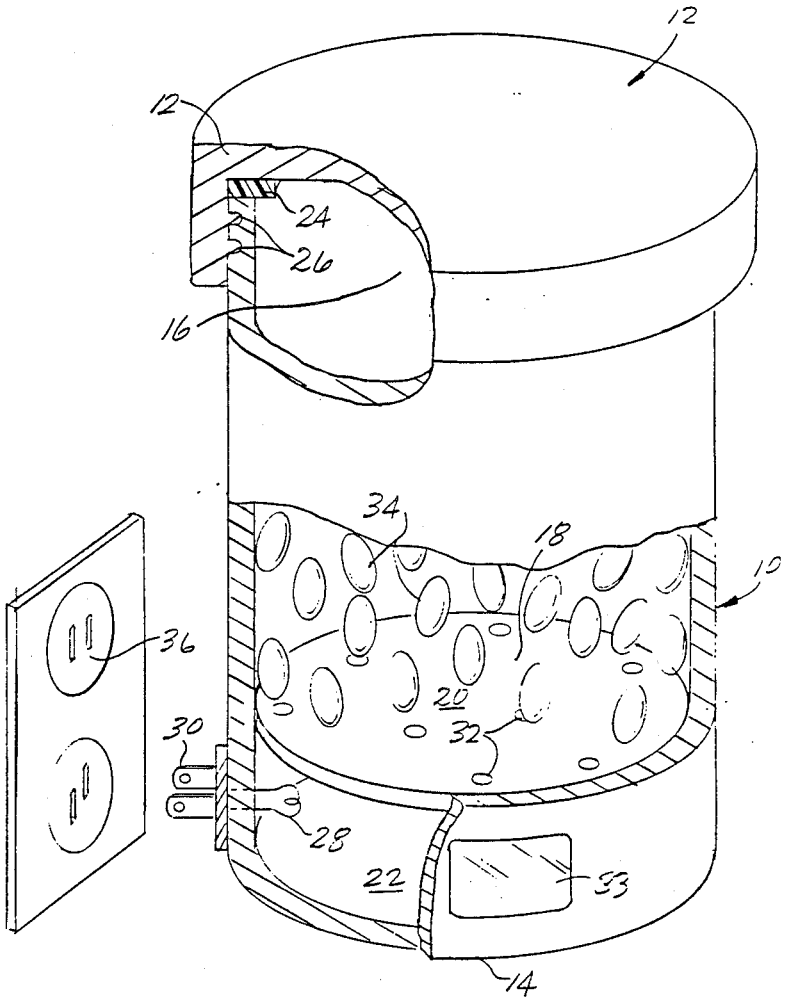
12
12
24
26
16
34
18
10
36
20
32
30
28
22
33
14

TAMPER RESISTANT PACKAGE AND METHOD FOR DETECTING TAMPERING WITH A PACKAGED PRODUCT

BACKGROUND OF THE INVENTION

This invention relates to consumer product packaging and, more particularly, to a tamper resistant package and a method for detecting tampering with a packaged consumer product.

In recent years, attention has been focused on the development of tamper resistant consumer packages. The objective is to insure that the integrity of the package is not violated during storage between the time the product is packaged and the time the product is used by a consumer.

One approach has been to seal the access opening of the product container or the lid that covers the access opening. If the seal has been broken, the consumer has warning of tampering. The problem is that in some packages the product can be contaminated by inserting a hypodermic needle through the seal or the container wall. Sometimes it is also possible to reseal the package after it has been opened, without a telltale.

Another approach has been to atmospherically evacuate and seal the package while the package is being filled with its product and to use a chemical indicator in the seal or the interior of the package. The chemical indicator undergoes a color change if a component of an aerobic atmosphere such as oxygen or water vapor, is present. Klein et at U.S. Pat. No. 4,511,052 and Perlman et al U.S. Pat. No. 4,526,752 disclose chemical indicators incorporated in tamper resistant packages. The use of such a chemical indicator may substantially increase the cost of product manufacture because the packaging process must be carried out in an anaerobic atmosphere so the indicator is not activated before the package is sealed.

Further, in current package designs using an oxygen or water vapor indicator, it may be possible to replace the indicator with a dummy look-a-like after the package has been opened because the indicator is freely accessible after the lid has been removed.

SUMMARY OF THE INVENTION

According to one aspect of the invention, a tamper resistant package has an inaccessible aerobic atmosphere indicator. Specifically, the package comprises a container having an access opening, a first interior compartment for product storage exposed to the access opening, a second interior compartment isolated from the opening, and a lid adapted to seal the access opening. An aerobic atmosphere indicator is disposed in the second compartment. The response of the indicator is transmitted to the exterior of the container. Gas flow is permitted from the first compartment to the second compartment without permitting removal of the indicator from the second compartment. As a result, the indicator is protected from tampering in the event the seal is broken and the lid is opened.

Another aspect of the invention is a tamper resistant package and method for detecting tampering that employ an activatible aerobic atmosphere indicator. A product for human consumption and the indicator in its unactivated state are placed in a sealable package. Thereafter, prior to use the package is atmospherically evacuated and sealed. Pending use of the product, the resulting package is then stored. Thereafter, the indicator is activated to determine whether the interior of the package has been violated during storage. If the package tests negative, the container is opened and the product is removed for consumption.

A feature of the invention is the use of an electrical indicator such as an unenveloped incandescent filament. Such an indicator is activatible and reliable. To activate the indicator and test the package for tampering before opening, an electric current is passed through the filament. If the atmosphere in the package is aerobic, the filament will oxidize, preferably to the point of disintegration. Operation is therefore fail-safe in the sense that the filament glows only if the indicator is operative and the integrity of the package has not been violated. If either of these conditions is not met, the package tests positive, thereby warning the consumer against use of the product.

BRIEF DESCRIPTION OF THE DRAWINGS

The features of a specific embodiment of the best mode contemplated of carrying out the invention are illustrated in the drawing, the single FIGURE of which is a perspective, partially cut away view of a tamper resistant package illustrating the features of the invention.

DETAILED DESCRIPTION OF THE SPECIFIC EMBODIMENT

In the drawing, a tamper resistant package comprises a container 10 and a lid 12. Container 10 and lid 12 could be made of any conventional airtight packaging materials such as plastic or glass configured in any desired shape. For simplicity, container 10 is illustrated as a hollow cylinder closed at one end by a container bottom 14 and open at the other end to form a product access opening 16. Container 10 has an integral partition 18 closely spaced from bottom 14 in parallel relationship thereto, to form in container 10 an interior compartment 20 for product storage exposed to access opening 16 above partition 18 and an interior compartment 22 isolated from access opening 16 below partition 18. Lid 12 is adapted to close and seal access opening 16 in conventional fashion. For example, the interior of lid 12 has an annular elastomeric seal 24 that bears against the top surface of container 10 and a threaded connection 26 with the exterior surface of container 10.

An aerobic atmosphere indicator in the form of an unenveloped incandescent filament 28 is disposed in compartment 22 and attached to the interior wall of container 10. Filament 28 could comprise a carbon or tungsten wire of the type used in flashlights without the envelope. A conventional two pronged electrical appliance plug 30 is mounted on the exterior of container 10. The ends of filament 28 are electrically connected to the prongs of plug 30 inside compartment 22. This could be accomplished by hard wire or inductive or capacitive coupling. If desired, plug 30 and filament 28 as a unit could be molded into container 10 during its manufacture to form an integral, sealed structure. In the construction of container 10, it is important that filament 28 lie entirely in compartment 22 unexposed to the air outside the package. A transparent or translucent area of the side wall of container 10 forms a window into compartment 22 to permit observation of filament 28 from the exterior of the package. If desired, container 10 could be fabricated entirely from transparent or translucent material. Perforations 32 preferably having smaller dimensions than the cross section of filament 28 are formed in partition 18 to permit gas to flow from compartment 20 to compartment 22. It should be noted that by virtue of the attachment of filament 28 and plug 30 to container 10 and or the presence of the partition 18 with perforations 32 having smaller dimensions than filament 28, removal of filament 28 from compartment 22 is precluded.

If atmospheric air is present in compartment 22 when electric current is passed through filament 28, it will oxidize. The speed of oxidation and the effect on filament 28 depend upon the magnitude of current and resulting temperature and the extent of rarification of the interior of container 10. In this embodiment of the invention, which relies upon a visible change in filament 28, it is preferable to pass sufficient current through filament 28 to cause it to glow for at least a minimum time period, e.g., two minutes in an anaerobic atmosphere and to burn out in less than the minimum time in an aerobic atmosphere.

In addition to the described tamper resistant package, the invention encompasses a method to detect tampering with a packaged consumer product. Specifically, filament 28 is placed in compartment 22 or the package, during or after its construction. Filament 28 serves as an activatible, aerobic atmosphere indicator in its inactivated state because electric current is not being passed through filament 28 at this time. After the package is constructed, a product for human consumption, designated 34, is placed in compartment 20. The product may be designed for oral, topical or intravenous use. Thereafter, the container is sealed to prevent air from entering copartments 20 and 22. The preceding steps can be carried out in an aerobic atmosphere, in which case the interior of the package must be atmospherically evacuated by conventional means before it is sealed. If desired, a so called getter, a harmless oxidizing agent, can be used to assist in evacuating the package. Next, the package is stored pending use of the product by a consumer. It is during this storage period that tampering with the product may take place. When a consumer later wishes to use the package, he or she inserts plug 30 into a conventional wall socket 36 to pass current from a standard 110 volt, 60 cycle alternating current power source through filament 28. This serves to activate the indicator i.e., filament 28. If filament 28 is intact i.e., operative, and the interior of the package has not been violated during storge, filament 28 glows, the resulting light is transmitted through window 33 to the exterior of the package, and the consumer is assured that the product has not been contaminated. If lid 12 has been opened or the integrity of the interior of the package has been otherwise violated, air from the exterior atmosphere is present inside the package. This air passes from compartment 20 through perforations 32 to compartment 22. As a result, when electric current passes through filament 28, it rapidly oxidizes due to the high temperature and disintegrates, thereby burning out filament 28 and preventing it from glowing further. The resulting indication of an aerobic atmosphere in the package, observed by the consumer through window 33 by the absence of light, warns the consumer not to use the product in the package. If filament 28 is damaged during storage so that it is not able to function as an aerobic atmosphere indictor, filament 28 will not glow when plug 30 is inserted in outlet 36 and the consumer is again warned by the absence of light through window 33 not to use the product in the package. Thus, the decribed operation is fail-safe in the event of failure of the indicator. If the package tests negative to the presence of air, it is opened and the product is removed for consumption.

The term "aerobic atmosphere" as used herein refers to a gas mixture comprising as constituents the components of atmospheric air. The indicator senses the presence of one of these components e.g., oxygen or water vapor, normally present in atmospheric air. The term "anaerobic atmosphere" refers to the presence of gas components e.g., oxygen or water vapor, in a smaller quantity than is present in atmospheric air. The quantity of the sensed compoment, for example oxygen, indicative of an anaerobic atmosphere, depends upon the extent of rarification achieved in evacuating the interior of container 10.

The described embodiment of the invention is only considered to be preferred and illustrative of the inventive concept; the scope of the invention is not to be restricted to such embodiment. Various and numerous other arrangements may be devised by one skilled in the art without departing from spirit and scope of this invention. For example, the feature employing two compartments, one isolated from the access opening of the container, can be utilized with a chemical indicator of the type described in the prior art. In such case the chemical indicator is protected from tampering by the perforated partition. Instead of a perforated partition a screen could be used so long as the necessary structural strength is provided. The activatible indicator could take the form of a two part chemical system, the compoments of which are physically separated until such time as the indicator is to be activated. Furthermore, an electrical indictor could take a form different from a filament, the underlying function being the sensing of the presence of a component of an aerobic atmosphere responsive to electric current flow, or the electric and magnetic fields normally associated therewith.

What is claimed is:

1. A tamper resistant package comprising:

a container having a product access opening, a first interior compartment for product storage exposed to the access opening, and a second interior compartment isolated from the access opening;

a lid adapted to close and seal the access opening;

an unenveloped incandescent filament in the second compartment for indicating the absence of an aerobic atmosphere therein;

means for permitting gas to flow from the first compartment to the second compartment without permitting removal of the filament from the second compartment; and a window in the second compartment for transmitting the indication to the exterior of the container.

2. The package of claim 1, in which the second compartment is in part formed by a partition between the first and second compartments and the permitting means comprises a plurality of perforations in the partition.

3. The package of claim 2, in which the indicating means has given minimum cross-sectional dimensions and the perforations are smaller than the given cross-sectional dimensions.

4. The packge of claim 1, additionally comprising an electric plug on the exterior of the container connected to the filament within the container.

5. A tamper resistant package comprising:

a sealed container in which a product for human consumption is stored in an anaerobic atmosphere;

an unenveloped incandescent filament in the container in the anaerobic atmosphere;

a window in the container for permitting external observation of the filament; and electric terminals outside the container connected to the filament inside the container.

6. The package of claim 5, in which the terminals comprise an electrical appliance plug adapted to be inserted into an electrical outlet.

7. A method for detecting tampering with a packaged consumer product comprising the steps of:

(a) placing in a sealable package a product for human consumption;

(b) placing in the package an unenveloped incandescent filament;

(c) atmospherically evacuating and sealing the container after steps (a) and (b);

(d) storing the container after step (c) pending use of the product; and (e) passing electric current through the filament after step (d) to determine whether the interior of the container has been violated during storage.

8. The method of claim 7, additionally comprising the step of opening the container and removing the product for consumption only if the filament glows when electric current is passed therethrough pursuant step (e).

* * * * *